US005809942A

United States Patent [19]

Kralovec et al.

[11] Patent Number: 5,809,942

[45] Date of Patent: Sep. 22, 1998

[54] POOL AND SPA WATER HEATER

[76] Inventors: William M. Kralovec, 2154 Horseshow La., Delavan, Wis. 53115; Paul T. King, 3807 N. Wilton #3, Chicago, Ill. 60613

[21] Appl. No.: 748,627

[22] Filed: Nov. 13, 1996

[51] Int. Cl.[6] ..... F22B 15/00

[52] U.S. Cl. ..... 122/235.14; 4/493

[58] Field of Search ..... 4/493; 122/235.14

[56] References Cited

U.S. PATENT DOCUMENTS

| | | | |
|---|---|---|---|
| 4,682,568 | 7/1987 | Green et al. | 122/235.14 |
| 4,924,069 | 5/1990 | Giordani | 4/493 |

OTHER PUBLICATIONS

Teledyne Laars Model ESG Pool and Spa Heaters Sales Brochure by Teledyne Laars, Moorpark, CA, Apr. 1993.

Hayward Meet your new Flame Brochure by Hayward of Pomona, CA (Undated Brochure).

Triton Millivolt Pool/Spa Heater Minimax Brochure by Pac–Fab, Inc., Sanford, NC, Nov. 30, 1994.

Raypac Versa Spa Heater Family Brochure by Raypac, Inc., Westlake Village, CA, Oct. 1, 1994.

Raypac RP2100 Pool Heater Brochure What's the Smark Idea . . . Spa Heater? by Raypac, Inc., Westlake, CA, Dec. 1, 1993.

*Primary Examiner*—Ronald C. Capossela

[57] ABSTRACT

A pool and spa water heater has a base and an enclosure coupled to the base. The enclosure includes a pair of curved, "shell-like" enclosure components coupled to the base by an overlapping attachment device, e.g., a tongue-and-groove device. The enclosure components may be removed from and attached to the base by moving each component laterally away from or toward the base. The new heater has a platform atop the enclosure for mounting a control panel. The platform and the support device to which the platform is mounted are cooperatively configured so that the platform may be indexed to any one of several positions with respect to the support device and the enclosure. Thus, after placing the base during installation, the control panel may be optimally and independently positioned with respect to the base.

14 Claims, 8 Drawing Sheets

POOL AND SPA WATER HEATER

FIELD OF THE INVENTION

This invention relates to heat exchangers of the stove/furnace type and, more particularly, to a heat exchanger for warming water in pools, spas, hot tubs and the like.

BACKGROUND OF THE INVENTION

Swimming pools, spas and hot tubs, both indoor and outdoor, are gaining in popularity and offer opportunities for exercise and relaxation. Even in hot, arid climates, it is (or at least may be) desirable to heat the water to a temperature which would otherwise naturally occur. One reason may be physiological—perhaps the pool/spa/tub user is sensitive to cold water. In temperate regions having winter seasons with snow, a heater is virtually essential during all but the warmest summer days. And, of course, hot tubs are (as their name suggests) intended to be filled with water above typical ambient air temperature.

There is no lack of products to meet the demand. Companies such as Raypak, Inc., Westlake Village, Calif.; Pac-Fab, Inc. of Sanford N.C. (selling the Triton brand heater) and Teledyne Laars of Moorpark, Calif., all offer products for heating pool and spa water. A leading manufacturer (and, in view of the invention, probably the leading manufacturer) of pool and spa heaters is Sta-Rite Industries, Inc. of Delavan and Waterford, Wis.

(In this specification and for convenience, such products are referred to as pool and spa heaters even though such heaters heat the water in the pool and spa rather than heating the pool or spa per se. This is also consistent with industry terminology.)

Known pool and spa heaters share some common features. One is that the enclosures for such heaters are rectangular cabinets with four vertical sides and horizontal tops and bottoms. Another is that the control panel is on one of the vertical sides; the user may have to lean or stoop to see such panel. And the orientation of such panel with respect to such vertical side (or with respect to any other part of the heater) cannot be modified by the user.

Another common feature is that such known heaters have or at least seemingly have a single access door that can be removed to gain access to the heater interior. Sales literature depicting such heaters suggests that such access is limited to only a portion of the cabinet interior. To put it another way, it appears that one must disassemble substantially the entire cabinet in order to gain access to all of such interior.

And yet another feature shared by many of the known pool and spa heaters is that the top surface has vent louvers in it. The user must either tolerate the entry of rain (and in certain regions, snow) into such louvers or construct a separate enclosure or at least a roof to prevent such entry. (This apparent disadvantage is based upon the belief that significant amounts of vagrant water in the heater can only be harmful to it.)

Still another common feature involves the two connections to the heater for introducing cold water into the heater and permitting heated water to flow to the pool or spa. The fact that the heater enclosure is rectangular and that the connections are fixed with respect to such enclosure means that the heater may be required to be mounted in an odd position to best accommodate incoming and outgoing water pipes. In other words, known enclosures have little symmetry that would otherwise afford what might be termed "positioning freedom" while yet retaining an aesthetic appearance of the heater with respect to its surroundings.

And some known pool and spa heaters are made of sheet metal galvanized and painted or having a paint-like powder coating, usually in color. Sun fades color. At least based upon sales literature describing known heaters, no steps have been taken to inhibit the effect of ultraviolet light.

Heaters made of ferrous sheet metal will, almost inevitably over time, evidence a degree of rust. And heaters made of aluminum may, in time, corrode in the sometimes-chemical-rich environment of a swimming pool A new pool and spa heater that addresses shortcomings of known heaters would be an important technical advance.

OBJECTS OF THE INVENTION

It is an object of the invention to provide a new pool and spa heater overcoming some of the problems and shortcomings of prior art heaters.

Another object of the invention is to provide a new pool and spa heater having a control panel which, for optimum user convenience, can be repositioned with respect to the enclosure.

Another object of the invention is to provide a new pool and spa heater, the control panel of which faces generally upwardly for easy viewing.

Yet another object of the invention is to provide a new pool and spa heater which resists ultraviolet light.

Another object of the invention is to provide a new pool and spa heater which resists sun-fading.

Another object of the invention is to provide a new pool and spa heater configured to permit easy access to substantially the entirety of the heater interior cavity.

Still another object of the invention is to provide a new pool and spa heater having vents configured to prohibit entry of rain and snow.

Another object of the invention is to provide a new pool and spa heater, the exterior of which is impervious to rust and corrosion.

Another object of the invention is to provide a new pool and spa heater which affords a new method for opening the heater and for positioning and repositioning the heater control panel. How these and other objects are accomplished will become apparent from the following descriptions and from the drawings.

SUMMARY OF THE INVENTION

The invention involves dramatic improvements in a pool and spa water heater of the general type having a base and an enclosure coupled to the base. In one improvement, the enclosure includes a plurality of "shell-like" enclosure components which are coupled to the base by an attachment device. Such device has first and second portions overlapping one another and securing the components and the base to one another. The base has an outer perimeter and the first portion is around such perimeter. Each of the enclosure components has an interior surface and the second portion extends along the interior surface of each component.

In more specific aspects, the heater has a central vertical axis, the first portion projects away from the axis and the second portion projects toward it. In a highly preferred embodiment, the outer perimeter is circular and the first portion is an outwardly-projecting bead around such perimeter. Each interior surface defines an arc of a circle and the second portion includes a pair of inwardly-projecting beads overlapping the outwardly-projecting bead.

The attachment device resembles a "tongue-and-groove" arrangement and while such device prevents axial movement of an enclosure component and the base with respect to one another, such arrangement readily permits translational movement of an enclosure component toward or away from the base. Thus, the enclosure components are very easy to mount on the base and very easy to remove from the base when installing and servicing the heater. (The term "translational movement" and like terms used herein are based upon the definition of "translation" from the field of engineering mechanics and kinematics, i.e.,: when a rigid body moves in such a manner that all lines in the body remain parallel to their original positions, the body has a motion of translation.)

An embodiment of the new heater is gas-fired and requires enclosure cooling. In another aspect of such heater, the base includes a body having an upper portion and a rim around the body and spaced away from such upper portion. A generally horizontal panel extends between and joins the body and the rim and the panel includes a plurality of vent holes therein for admitting cooler ambient air into the enclosure and permitting air to circulate within such enclosure.

More specifically, the plurality of vent holes includes first and second groups of rather-closely-spaced holes and an imperforate portion between the groups. At least one of the enclosure components includes a vent aperture so that hot air can escape from the enclosure. The vent aperture is above the base panel and air circulates in the enclosure because of "chimney effect." Most preferably, each enclosure component has a vent aperture and the aggregate area of such vent aperture(s) is at least equal to the aggregate area of the holes in the base panel.

Another aspect of the invention involves a new method for opening a pool and spa water heater having an interior cavity. The method includes the steps of providing a heater having a base and first and second enclosure components coupled to the base by an attachment device having first and second portions overlapping one another, removing the first enclosure component from the base by translationally moving the first enclosure component with respect to the base and removing the second enclosure component from the base by translationally moving the second enclosure component with respect to the base, thereby gaining access to the interior cavity.

In more specific aspects of the method, each of the first and second enclosure components is curved. Such components abut one another when mounted on the base and the first moving step is preceded by the step of removing at least one fastener extending between the components and coupling the components in position with respect to the base.

Another aspect of the invention involves the heater electronic control panel and features which makes the position of such control panel very easy to adjust. The heater has a support device in the heater cavity and a platform is above such support device. The heater control panel is fixed with respect to the platform and a mechanism couples the support device and the platform to one another.

The mechanism includes a plurality of openings in the support device and plural coupler tabs extending from the platform into respective openings. Most preferably, the plurality of openings includes indexing openings spaced from one another and having a particular geometric shape, e.g., T-shape. The platform includes an indexing tab extending therefrom and having the geometric shape. When the heater is so configured, the platform may be mounted at any one (and only at any one) of several different positions with respect to the support device.

This configuration offers at least two advantages. One is that after mounting the base and otherwise installing the heater, the control panel may be positioned at a location most convenient for the user. Another advantage relates to the fact that the heater has a flue vent from which the very-hot byproducts of combustion are vented to atmosphere. The support device and platform are cooperatively configured so that it is not possible to mount the control panel directly above the flue vent.

And that is not all. In a specific embodiment, the heater includes at least one spring coacting between the support device and the platform. When the platform is positioned on the support device as desired, hand pressure is released from such platform and the spring biases it upwardly slightly away from the enclosure. A slit-like vent gap is thereby formed between the enclosure and the platform.

The new heater also has an innovative feature for quickly and securely joining two parts during assembly. The heater has a stack for venting the byproducts of combustion in the firing unit. A vent body is mounted to the stack in spaced telescoped relationship to such stack and such body includes at least one tubular injection port. Such port is used for injecting a bonding compound between the stack and the body.

Yet another aspect of the invention involves a new method for positioning the control panel with respect to the base. The method includes the steps of providing the support device having first and second groups of openings therein and providing the platform holding the control panel and having at least two coupler tabs extending from the platform into the first group of openings. The coupler tabs are withdrawn from the first group of openings and then inserted into the second group of openings.

In a more specific aspect, the platform is coincident with an axis and the inserting step is preceded by the step of rotating the platform with respect to the axis. Most preferably, the rotating step includes rotating the platform a predetermined number of degrees.

In another, more specific aspect, the withdrawing step is preceded by the step of moving the platform along the axis by, e.g., depressing it toward the enclosure. The moving step includes stressing at least one spring.

In a highly preferred embodiment, the support device and coupler tabs are inaccessible unless at least one of the enclosure components is removed. This configuration helps prevent unauthorized "tinkering" with the platform and control panel positions. In this arrangement, the withdrawing step is preceded by the step of moving one of the components with respect to the base and, most preferably, by removing both components from the base.

Other aspects of the invention are set forth in the following detailed description and in the drawings.

DETAILED DESCRIPTIONS OF THE PREFERRED EMBODIMENTS

Figure 1:
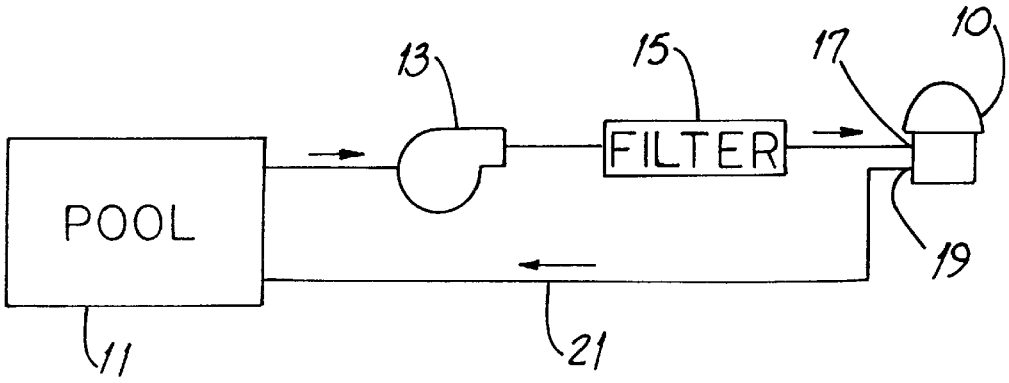
FIG. 1 is a representative view of the new pool and spa heater shown in conjunction with a pool and a water circulating system for such pool.

Before describing the new pool, spa and hot tub heater 10, it will be helpful to have an understanding of how the heater 10 is used. Referring to FIG. 1, cool or cold water is drawn from the pool, flows to an exemplary pump 13 and filtering system 15, and is delivered to the heater 10 through the inlet port 17. The water is heated and flows from the heater discharge port 19 back to the pool 11 along the line.

Referring next to FIGS. 2, 3, 4 and 5, the new heater 10 includes a base 23, an enclosure 25 formed of mating "shell-like" first and second enclosure components 27, 29, respectively, mounted to the base 23 and a platform 31 and control panel 33 atop the enclosure 25. Each is described in detail below.

Figure 2:
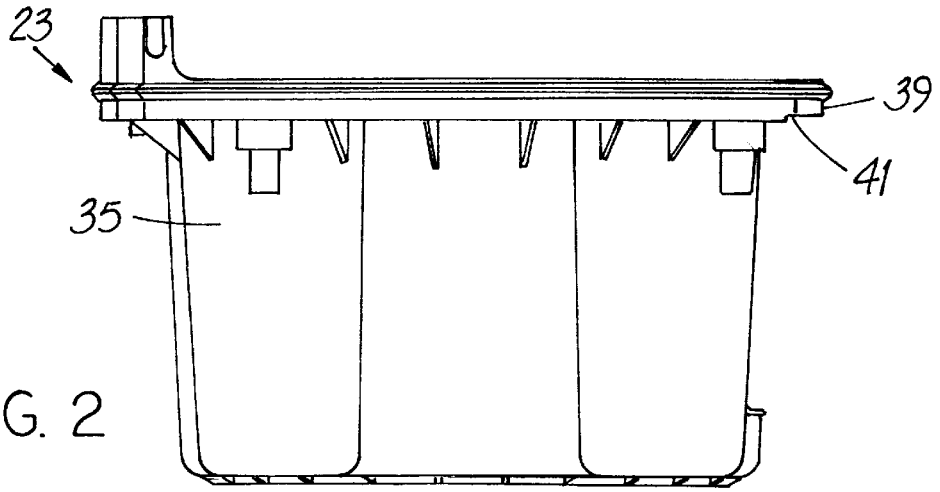
FIG. 2 is an elevation view of the base of the new heater.
Figure 3:
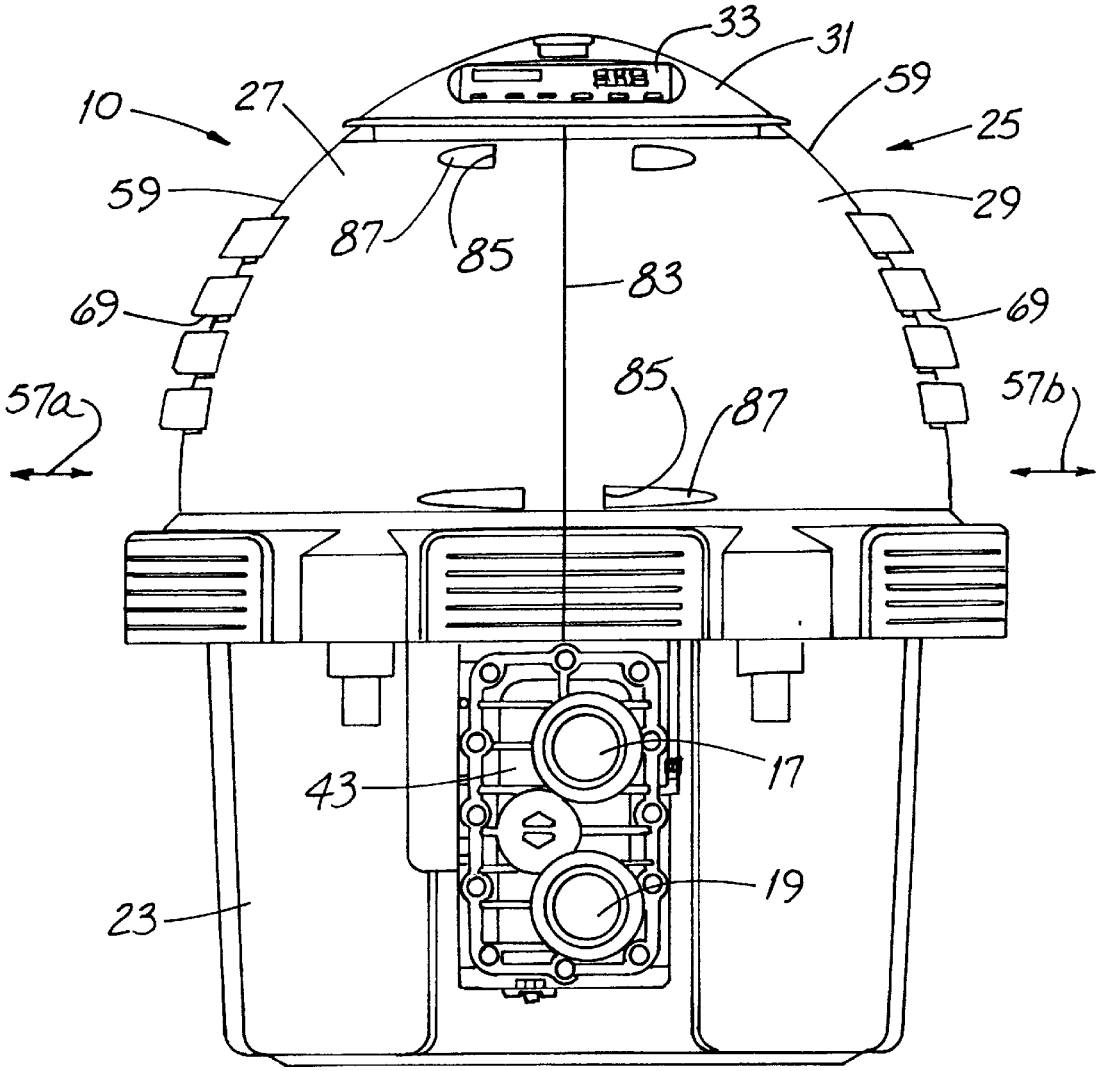
FIG. 3 is a front elevation view of the heater.
Figure 5:
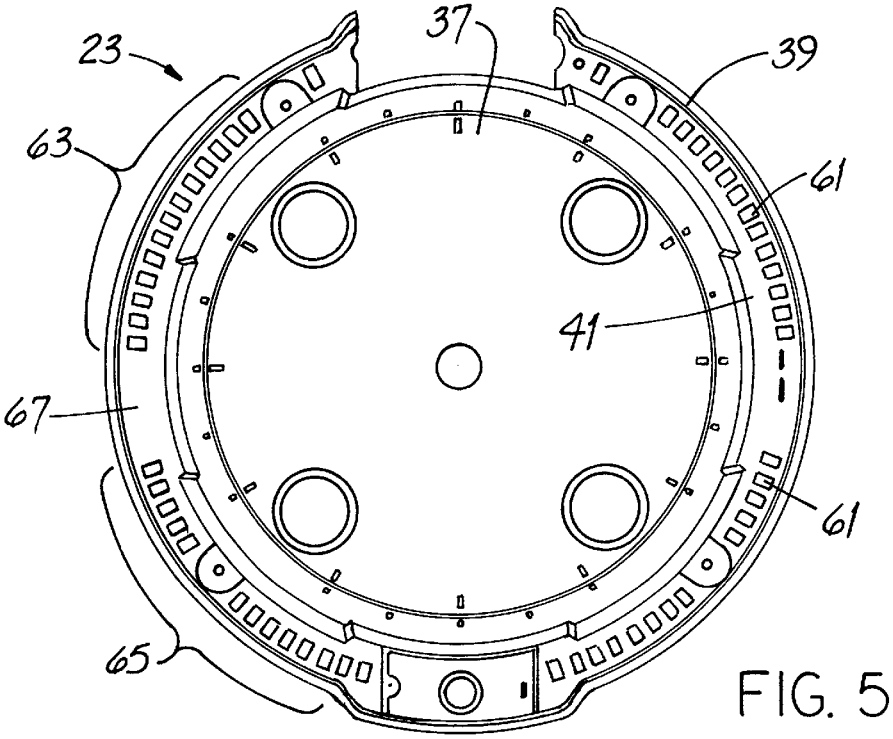
FIG. 5 is a top plan view of the heater base shown in FIG. 2.

Referring particularly to FIGS. 2, 3 and 5, the base 23 has a generally-circular body 35, a body bottom 37, an enlarged annular rim 39 at the top of the body 35 and an annular, substantially horizontal panel 41 extending between and joining the rim 39 and the body 35 to one another. A water connection manifold 43 is mounted on the base 23 and affords connection ports 17, 19 respectively, for incoming and outgoing water lines to the heater 10. Most preferably, the base 23 is made of flame retardant, heat and ultraviolet (UV) stabilized 30% glass coupled polypropylene RTP105 CC FR black black.

Figure 6:
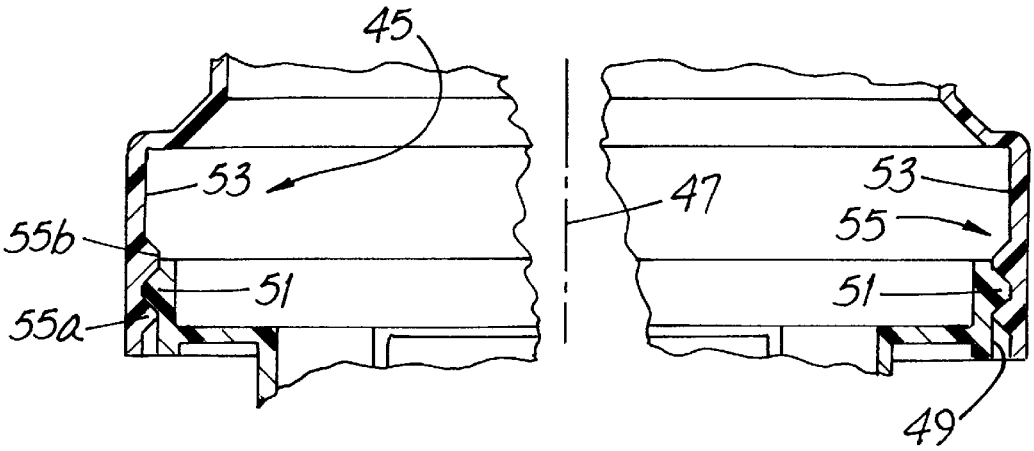
FIG. 6 is an enlarged view of the enclosure/base attachment device.
Figure 4:
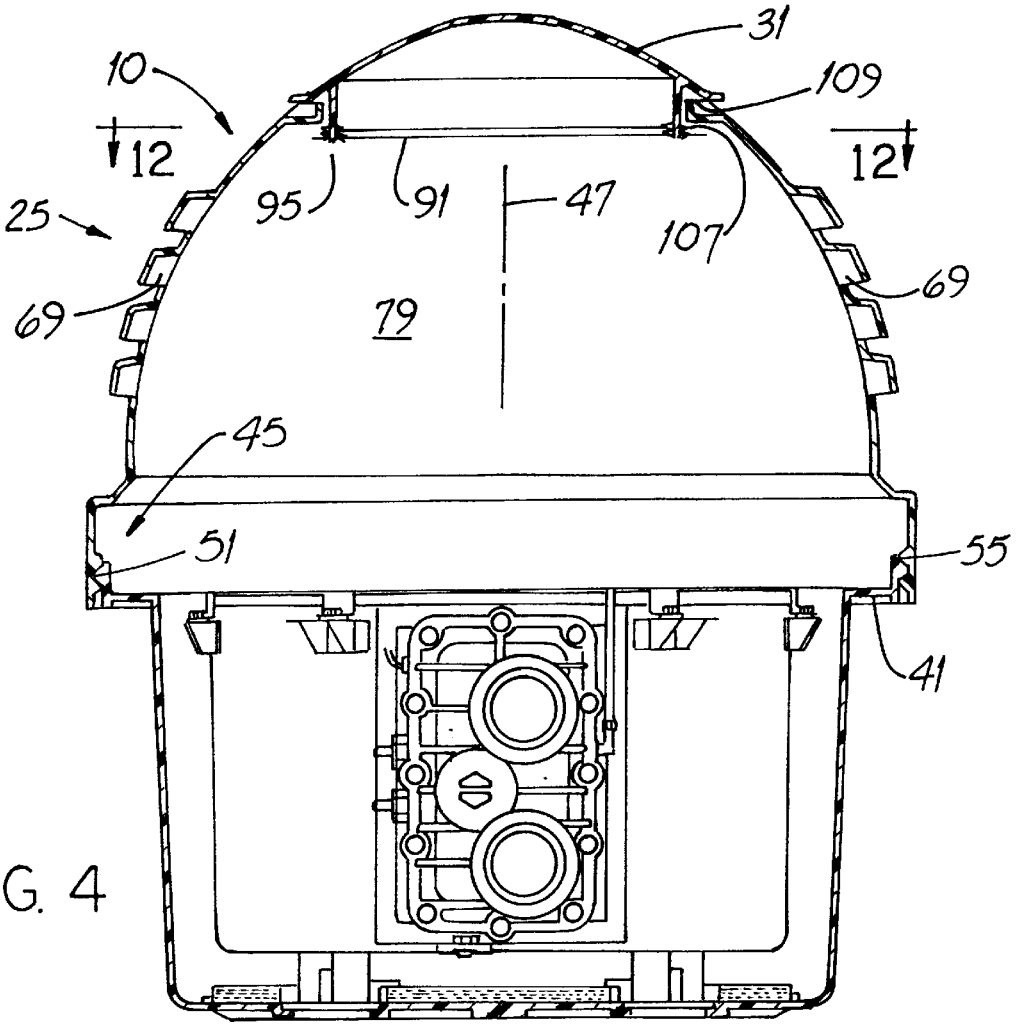
FIG. 4 is a front elevation view, partly in cross-section, of the heater. Internal parts of the heater are omitted for clarity.

Referring to FIGS. 4 and 6, the heater 10 includes an attachment device 45 for securing the enclosure components 27, 29 and the base 23 to one another. The heater 10 has a central axis 47 which is vertical when the heater 10 is mounted on a horizontal surface. The base rim 39 has a generally circular outer perimeter 49 and the first portion 51, e.g., a bead, is around such perimeter 49 and projects away from the axis 47. Each of the enclosure components 27, 29 has an interior surface 53 which defines an arc of a circle. The second portion 55 (embodied as one or two beads) extends along the interior surface 53 of each component 27, 29 and projects toward the axis 47. The portions 51 and 55 overlap one another.

It is to be appreciated that if the second portion 55 is embodied as a single bead 55*a* and when the bead 55*a* is below the first portion 51, the enclosure components 27, 29 are restrained from upward movement with respect to the base 23. However, a second portion 55 embodied as two spaced beads 55*a*, 55*b* is preferred and restrains such components 27, 29 from both upward and downward movement with respect to the base 23.

Considered another way, the attachment device 45 resembles a tongue-and-groove arrangement. And while such device 45 prevents axial movement of an enclosure component 27 or 29 and the base 23 with respect to one another, such arrangement readily permits horizontal translational movement of an enclosure component 27, 29 toward or away from the base 23 as indicated by the arrows 57 in FIG. 3. Thus, the enclosure components 27, 29 are very easy to mount on the base 23 and remove from the base 23 when installing and servicing the heater 10.

And such components 27, 29 afford another benefit. To the passerby and to the weather elements, they present curved surfaces 59 which are angled with respect to the base bottom 37. Such surfaces 59 discourage sitting upon them and readily shed water and snow.

The illustrated embodiment of the new heater 10 is gas-fired and requires enclosure cooling. (It seems likely that enclosure cooling would be required if some other hydrocarbon fuel or electricity were to be used for water heating.) Referring to FIGS. 4 and 5, the panel 41 includes a plurality of vent holes 61 therein for admitting cooler ambient air into the enclosure 25 and permitting air to circulate within such enclosure 25.

The plurality of vent holes 61 includes first and second groups 63, 65, respectively, of rather-closely-spaced holes 61 and an imperforate portion 67 between the groups 63, 65. At least one of the enclosure components 27, 29 includes a louvered vent aperture 69 so that hot air can escape from the enclosure 25. The vent aperture 69 is above the base panel 41 and air circulates in the enclosure 25 because hot air rises and a "chimney effect" results. Most preferably, each enclosure component 27, 29 has a vent aperture 69 and the aggregate area of such vent aperture(s) 69 is at least equal to the aggregate area of the holes 61 in the base panel 41.

Figure 7:
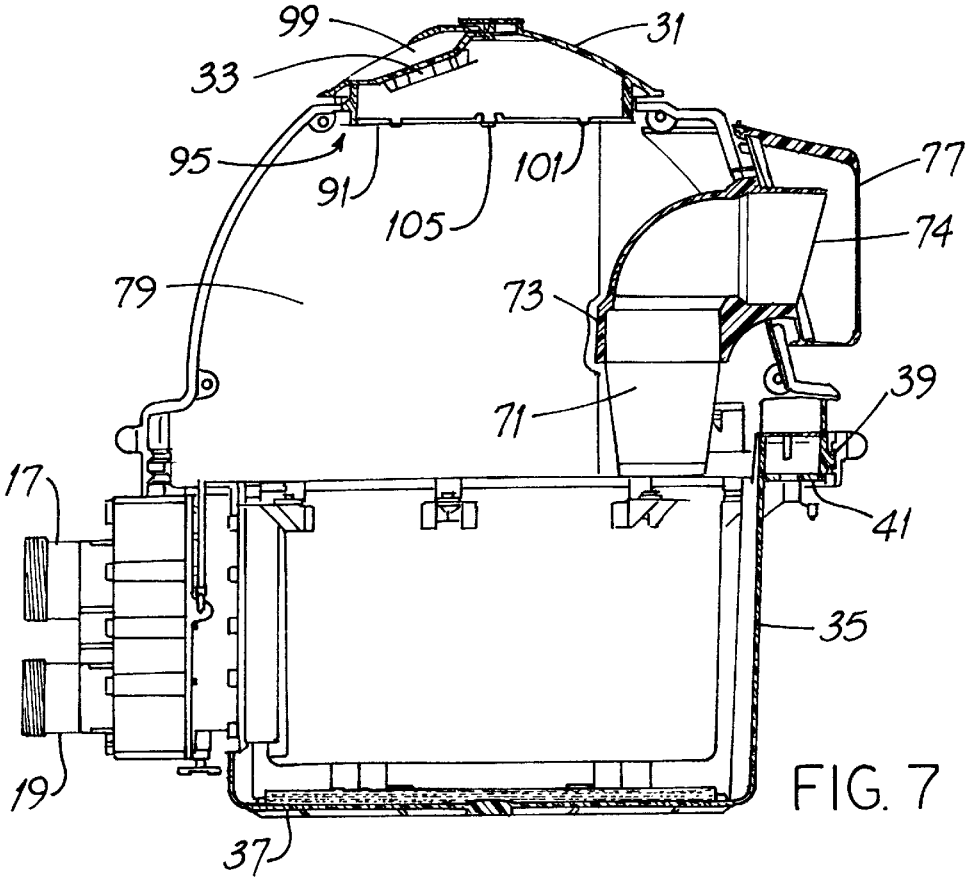
FIG. 7 is a cross-sectional elevation view of the left side of the heater. Internal parts of the heater are omitted for clarity.
Figure 9:
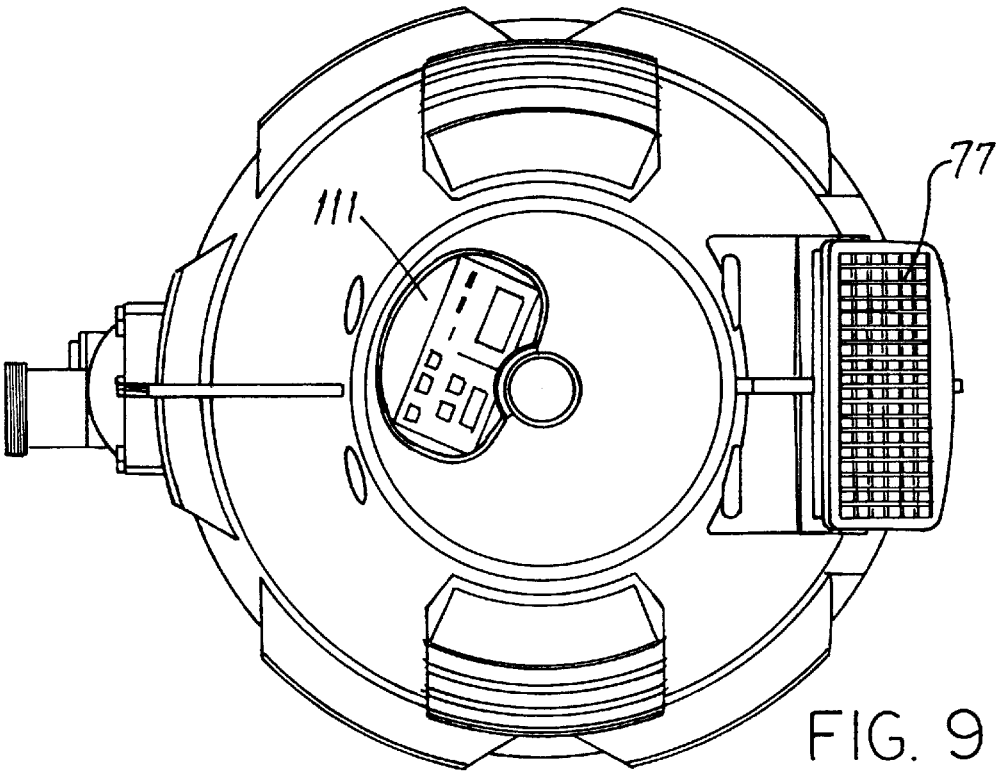
FIG. 9 is a top plan view of the heater.
Figure 8:
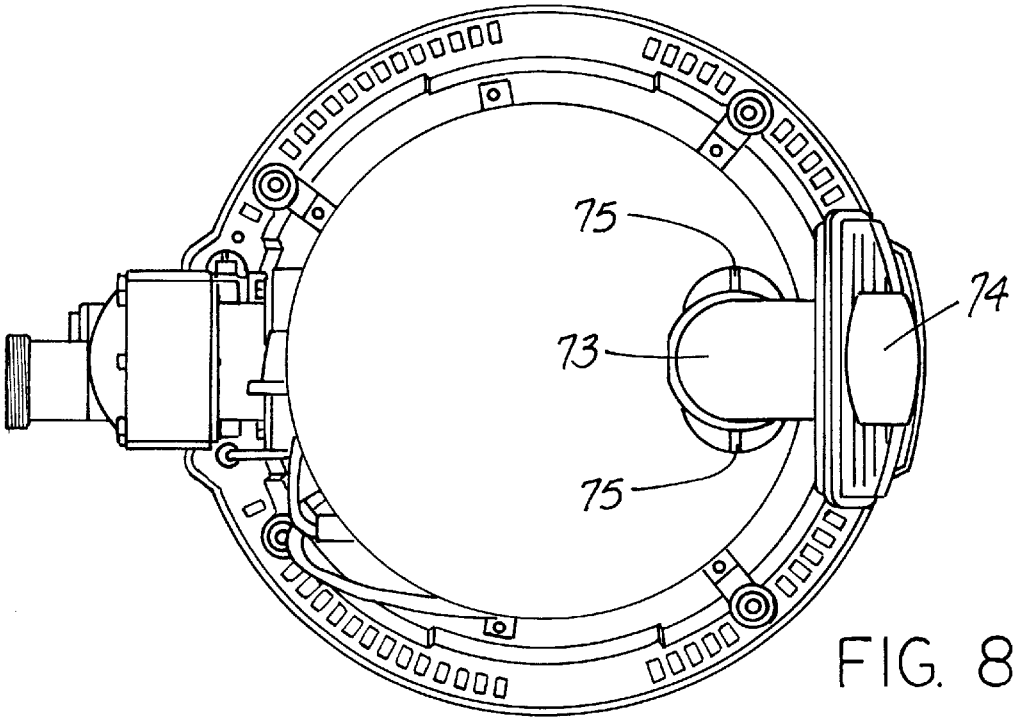
FIG. 8 is a top plan view of the heater with the base-mounted enclosure components removed. Internal parts of the heater are omitted for clarity.

Referring particularly to FIGS. 7, 8 and 9, the heater 10 has a stack 71 for venting the firing unit and a vent body 73 is mounted to the stack 71 in slightly-spaced telescoped relationship thereto. The body 73 includes at least one tubular injection port 75 through which a bonding compound is injected between the stack 71 and the body 73. The outward mouth 74 of the body 73 is shrouded by a latticed cover 77.

Another aspect of the invention involves a new method for opening a pool and spa water heater 10 to gain access to the heater interior cavity 79. The method includes the steps of providing a heater 10 having the base 23 and the first and second enclosure components 27 and 29, respectively, coupled to the base 23 by the attachment device 45 described above. The first enclosure component 27 is detached from the base 23 by translationally moving such component 27 with respect to the base 23 as indicated by the outwardly-pointing head of arrow 57*a*. And the second enclosure component 29 is detached from the base 23 by translationally moving that component 29 with respect to the base 23 as indicated by the outwardly-pointing head of arrow 57*b*.

Figure 10:
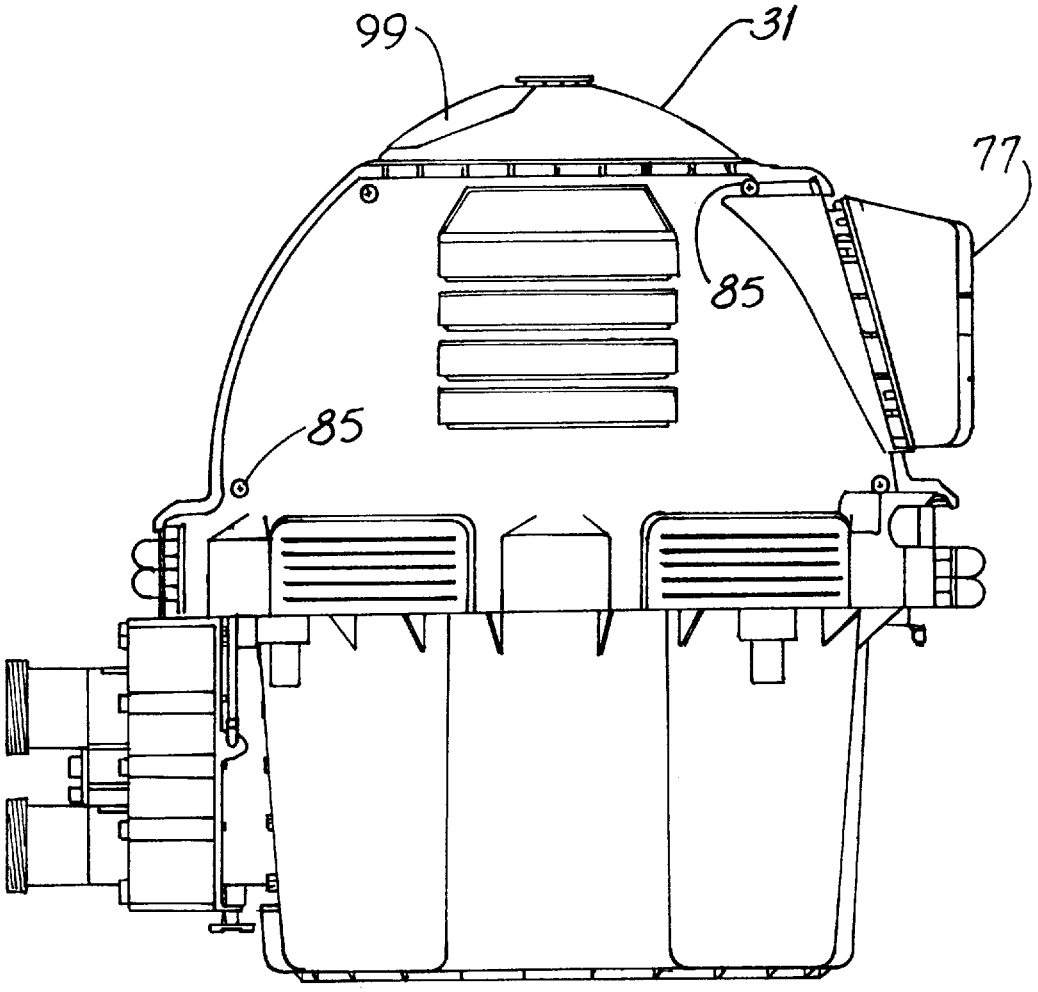
FIG. 10 is an elevation view of the left side of the heater.

As shown in FIGS. 3 and 10, each of the first and second enclosure components 27, 29 is curved. When mounted on the base 23, such components 27, 29 abut one another along the parting line 83 and the first moving step is preceded by the step of removing at least one fastener 85 extending between the components 27, 29. For reasons relating in part to aesthetics, the fasteners are "flush-recessed" in shallow depressions 87.

Referring now to FIGS. 3, 4, 7 and 10–14, another aspect of the invention involves the heater electronic control panel 33, the platform 31 on which the panel 33 is mounted and the coupler mechanism used to couple the platform support device 91 and the platform to one another. A horizontal disc-like support device 91 is rigidly mounted above the firing unit 93 near the top of (and inside of) the cavity 79. The coupler mechanism 95 includes a plurality of spaced-apart openings 97 in the support device 91 and most preferably, the openings are configured as indexing openings. That is, such openings 97 have a particular geometric shape, e.g., T-shape. For reasons related to the disclosure set out below, the openings 97 are considered to comprise a first group which includes openings 97*a*, and a second group which includes openings 97*b*.

Figure 12:
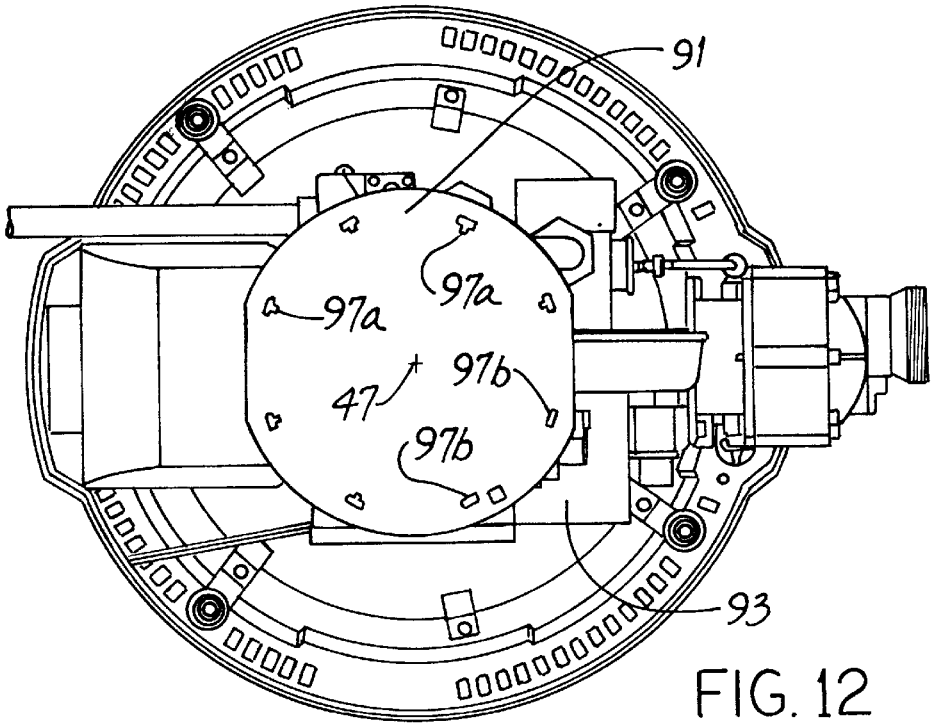
FIG. 12 is a view of the heater taken along the viewing plane 12—12 of FIG. 4 and with the enclosure components removed.

In the specific embodiment of FIG. 12, there are six openings 97*a* radially spaced about 35°–40° apart. As will become apparent, the platform 31 and the control panel 33 on the platform 31 may be indexed around the vertical axis 47 to any one of six different positions. However, configuring the heater 10 to provide more or fewer positions is certainly within the scope of the invention—after all, any opportunity to change the control panel position is an improvement over the prior art.

The control panel 33 is supported by the generally circular cap-like platform 31 positioned atop the enclosure 25. The control panel 33 is fixed with respect to the platform 31 which has a panel receiving well 99 in which the panel 33 "nests."

The coupler mechanism 95 also includes plural coupler tabs 101 which extend downwardly from the platform 31. Such tabs 101 have outwardly-facing hooked ends 103 and when the platform 31 is mounted to the device 91, such tabs extend into respective openings 97 in such device 91. The platform 31 also includes an indexing tab 105 extending therefrom and having the same geometric shape (in cross-section) as the indexing openings 97*a*. When the heater 10 is so configured, the platform 31 may be rotationally mounted at any one (and only at any one) of several different positions with respect to the support device 91.

Figure 13:
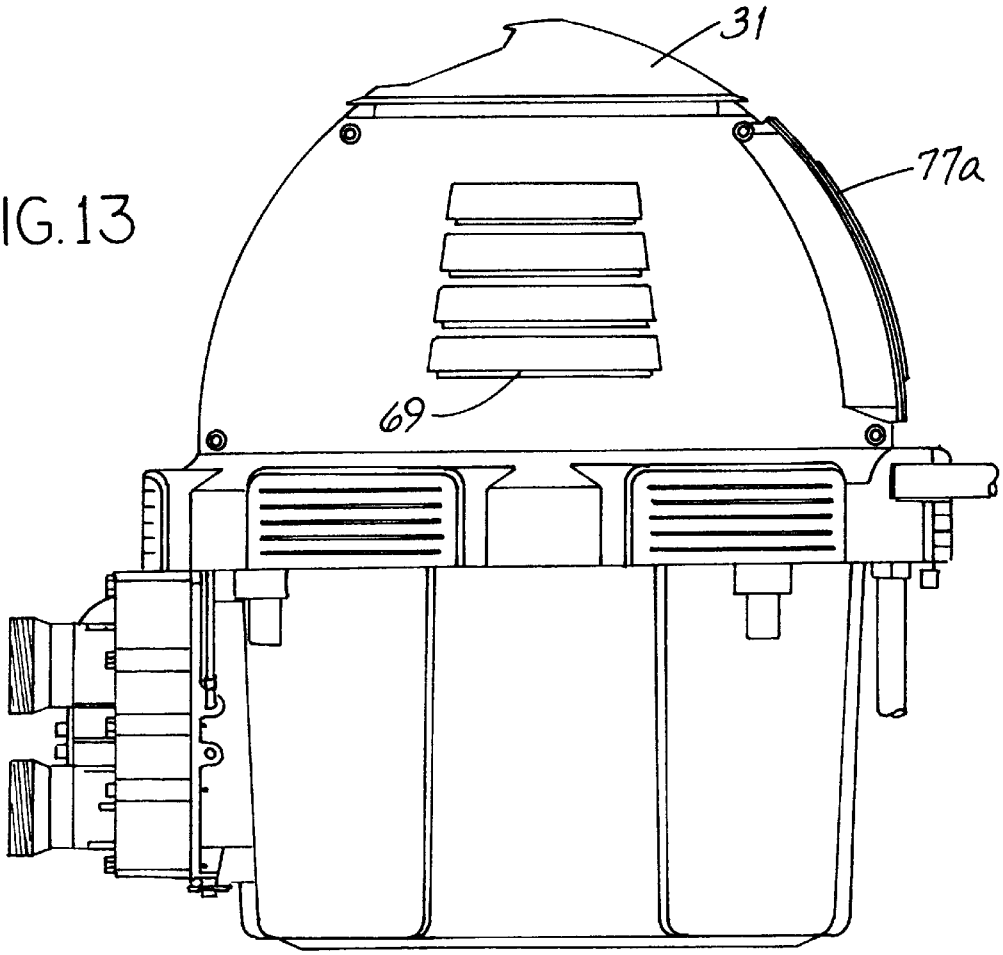
FIG. 13 is an elevation view of the left side of the heater which incorporates the alternate-embodiment louvered vent cover shown in FIG. 11.
Figure 14:
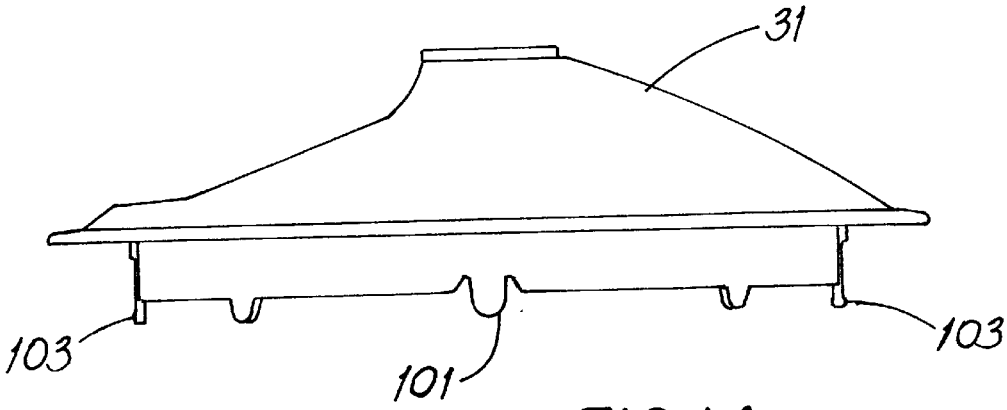
FIG. 14 is an elevation view of the platform on which the control panel is mounted.

From FIGS. 9, 10 and 13, it is to be noted that the heater 10 has the latticed cover 77 from which the very-hot byproducts of combustion are vented to atmosphere. Of course, such byproducts rise toward the platform 31. The locations of the openings 97 in the support device 91, the locations of the coupler tabs 101 and the index tab 105 and the location of the panel receiving well 99 with respect to such tabs 101, 105 are cooperatively selected so that a number of control panel positions are possible and yet the platform 31 is prevented from being oriented so that such control panel 33 is directly above the cover 77.

And the new heater 10 has yet other innovative features. Referring to FIG. 4, the heater 10 includes at least one coiled compression spring 107 coacting between the support device 91 and the platform 31. When the platform 31 is rotatably positioned on the support device 91 as desired, hand pressure is released from such platform 31 and the spring biases it upwardly to a position slightly away from the enclosure 25. A slit-like, heat-releasing vent gap 109 is thereby formed between the enclosure 25 and the platform 31.

From the foregoing descriptions, it will be appreciated that one must remove at least one enclosure component 27, 29 (and perhaps both components 27, 29) in order to squeeze the coupler tabs 101 toward one another and release the ends 103 from the device 91. This configuration is no accident and precludes an idle passer-by from twisting the platform 31 and placing the control panel 33 in an unwanted position.

The heater 10 affords a new method for positioning the control panel 33 with respect to the base 23. The method includes the steps of providing the support device 91 and the platform 31 as described above. To position the control panel 33, the coupler tabs 101 are withdrawn from the first group of openings 97*a* and then inserted into the second group of openings 97*b*.

In a more specific aspect, the platform 31 is coincident with the axis 47 and the inserting step is preceded by the step of rotating the platform 31 with respect to the axis 47. Most preferably, the rotating step includes rotating the platform 31 a predetermined number of degrees.

In another, more specific aspect, the withdrawing step is preceded by the step of moving the platform 31 along the axis 47 by, e.g., depressing it toward the enclosure 25. The moving step includes stressing at least one spring 107.

In a highly preferred embodiment, the support device 91 and coupler tabs 101 are inaccessible unless at least one of the enclosure components 27 or 29 is removed. This configuration helps prevent unauthorized "tinkering" with the platform and control panel positions. In this arrangement, the withdrawing step is preceded by the step of moving one of the components 27 or 29 with respect to the base 23 and, most preferably, by removing both components 27, 29 from the base 23.

Figure 15:
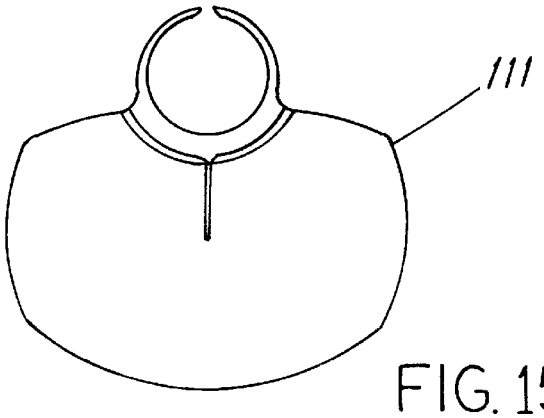
FIG. 15 is a top plan view of a control panel rain shroud.

The enclosure components 27, 29 are preferably molded from the material mentioned above and used to mold the base 23. The components 27, 29 and base 23 are substantially jet black in their finished forms. Black is the absence of color and is an ideal "blocker" of ultraviolet light. If not inhibited, such light is likely to impair the integrity of the plastic material used to make the base 23 and components 27, 29. And to protect the panel 33, it is desirable to place a clear, protective shroud 111 (shown in FIG. 15) over such panel 33.

Figure 11:
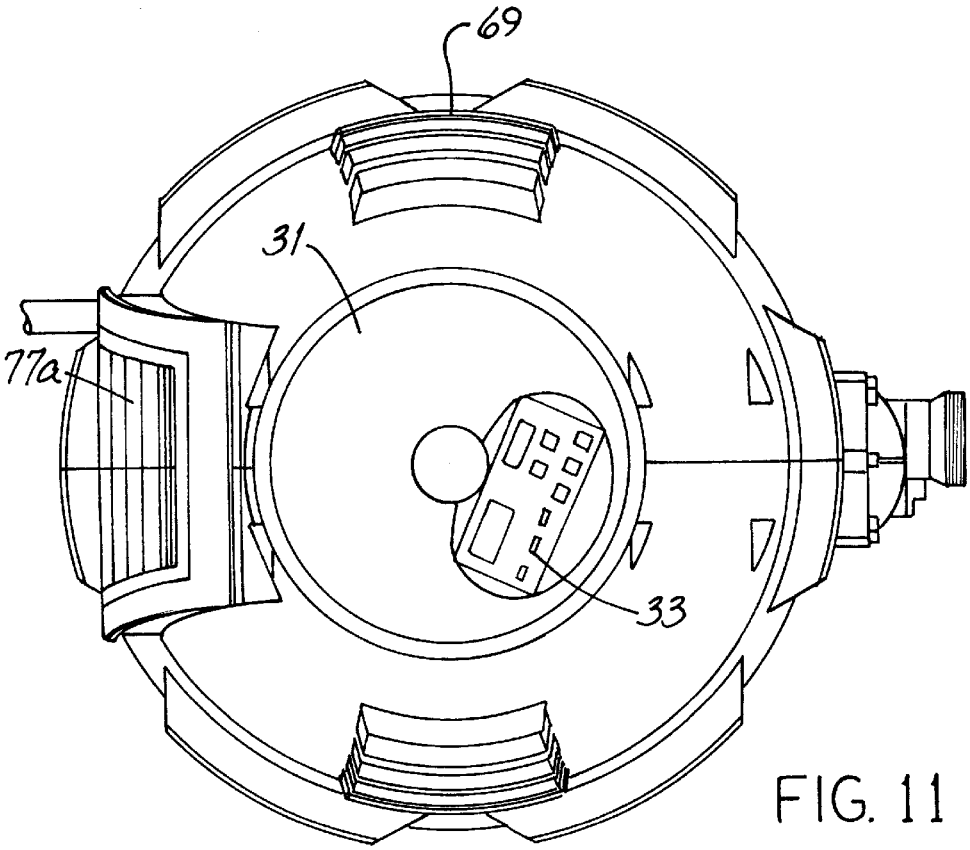
FIG. 11 is a top plan view of the heater which incorporates an alternate-embodiment louvered vent cover.

(It is to be appreciated that the type of louvered cover 77*a* shown in FIGS. 11 and 13 is operable. However, the cover 77 shown in FIGS. 9 and 10 is preferred.)

While the principals of the invention have been shown and described in connection with a few preferred embodiments, it is to be understood clearly that such embodiments are by way of example and are not limiting.

What is claimed:

1. In a pool and spa water heater having a base, an enclosure coupled to the base, a cold water inlet port and a hot water discharge port mounted to the enclosure, and a firing unit in the enclosure for transferring heat to water flowing from the inlet port to the discharge port, the improvement wherein:

the enclosure includes a plurality of enclosure components; and the components are coupled to the base by an attachment device having first and second portions overlapping one another and securing the components and the base to one another.

2. The heater of claim 1 including a central vertical axis and wherein the first portion projects away from the axis and the second portion projects toward the axis.

3. The heater of claim 2 wherein:

the base has an outer perimeter and the first portion is around the perimeter;

each of the enclosure components has an interior surface; and the second portion extends along the interior surface of each enclosure component.

4. The heater of claim 3 wherein:

the outer perimeter is circular and the first portion is an outwardly-projecting bead around the outer perimeter;

each interior surface defines an arc of a circle; and the second portion includes a pair of inwardly-projecting beads overlapping the outwardly-projecting bead.

5. The heater of claim 1 wherein:

the base includes a body and a rim around the body;

a panel extends between the body and the rim; and the panel includes a plurality of vent holes therein for circulating air within the enclosure.

6. The heater of claim 5 wherein:

the plurality of vent holes includes first and second groups of holes; and the panel includes an imperforate portion between the groups.

7. The heater of claim 5 wherein at least one of the enclosure components includes a vent aperture.

8. The heater of claim 1 including a cavity in the enclosure and wherein:

a support device is in the cavity;

a platform is above the support device; and a heater control panel is fixed with respect to the platform;

a mechanism couples the support device and the platform to one another, and wherein the mechanism includes:

a plurality of openings in the support device;

plural coupler tabs extending from the platform into respective openings, and wherein:

the platform is spaced from the enclosure, thereby forming a vent gap.

9. The heater of claim 8 wherein:

the plurality of openings includes indexing openings spaced from one another and having a geometric shape; and the platform includes an indexing tab extending therefrom and having the geometric shape, thereby configuring the heater so that the platform may be mounted at any one of several different positions with respect to the support device.

10. In a pool and spa water heater having a base, an enclosure coupled to the base, a cold water inlet port and a hot water discharge port mounted to the enclosure, a firing unit in the enclosure for transferring heat to water flowing from the inlet port to the discharge port, and a cavity in the enclosure, the improvement wherein:

the heater includes a support device in the cavity;

a platform is mounted with respect to the support device; and a heater control panel is fixed with respect to the platform.

11. The heater of claim 10 including a mechanism coupling the support device and the platform to one another and wherein the mechanism includes:

a plurality of openings in the support device; and at least one coupler tab extending from the platform into one of the plurality of openings.

12. The heater of claim 11 wherein plural coupler tabs extend from the platform into respective ones of the plurality of openings.

13. The heater of claim 11 wherein:

a spring urges the platform to a spaced relationship with respect to the enclosure, thereby forming a vent gap between the enclosure and the platform.

14. The heater of claim 10 including:

a vent stack and a vent body in spaced telescoped relationship to the vent stack; and the vent body includes at least one injection port for injecting a bonding compound between the stack and the body.

* * * * *